US011479999B2

(12) United States Patent
Terno

(10) Patent No.: US 11,479,999 B2
(45) Date of Patent: Oct. 25, 2022

(54) CARRIAGE WITH ELASTIC COMPENSATION ELEMENTS FOR MOVING SLIDING DOORS

(71) Applicant: TERNO SCORREVOLI S.P.A. UNIPERSONALE, Varedo (IT)

(72) Inventor: Giovanni Terno, Varedo (IT)

(73) Assignee: TERNO SCORREVOLI S.P.A. UNIPERSONALE, Varedo (IT)

( * ) Notice: Subject to any disclaimer, the term of this patent is extended or adjusted under 35 U.S.C. 154(b) by 0 days.

(21) Appl. No.: 17/040,279

(22) PCT Filed: Mar. 29, 2019

(86) PCT No.: PCT/EP2019/000101

§ 371 (c)(1),
(2) Date: Sep. 22, 2020

(87) PCT Pub. No.: WO2019/192749

PCT Pub. Date: Oct. 10, 2019

(65) Prior Publication Data

US 2021/0115718 A1 Apr. 22, 2021

(30) Foreign Application Priority Data

Apr. 6, 2018 (IT) ..... 102018000004273

(51) Int. Cl.
*E05D 15/06* (2006.01)
*E05F 5/00* (2017.01)

(52) U.S. Cl.
CPC ..... *E05D 15/063* (2013.01); *E05F 5/003* (2013.01); *E05Y 2201/64* (2013.01);
(Continued)

(58) Field of Classification Search
CPC ..... E05D 15/063
See application file for complete search history.

(56) References Cited

U.S. PATENT DOCUMENTS 2,230,744 A * 2/1941 Disbro ..... E05D 15/063 16/107
3,193,871 A * 7/1965 Foltz ..... E05D 15/063 210/98

(Continued)

FOREIGN PATENT DOCUMENTS

DE 2819396 A1 11/1979
DE 3602440 A1 7/1987
EP 2324176 A1 5/2011

OTHER PUBLICATIONS

International Search Report, dated Jun. 14, 2019 for corresponding PCT patent application No. PCT/EP2019/000101.

(Continued)

*Primary Examiner* — Victor D Batson
*Assistant Examiner* — Matthew J Sullivan
(74) *Attorney, Agent, or Firm* — Amster, Rothstein & Ebenstein LLP

(57) ABSTRACT

A carriage (10) provided with one or more pairs of wheels (14) for moving sliding door (42) is arranged in a sliding seat (44) of an extruded profile (28), made of aluminium or other suitable material and fixed to a wall (48) or ceiling (54). The extruded profile in which the carriage (10) is arranged comprises opposite side walls (30, 32), oriented orthogonally with respect to the upper base (34) and with respect to the lower base (36) of said profile; on said lower base a central slot (38) extending longitudinally is made for the passage of a stem (40) projecting downwards in the direction of the door (42) to which it is connected. The carriage (10) comprises a support body (12) made of plastic, metal or other suitable material, constituting the load-bearing frame of said carriage to which the pairs of wheels (14) are connected, with rivets (16); each of the wheels is paired with (Continued)

Figure 1:
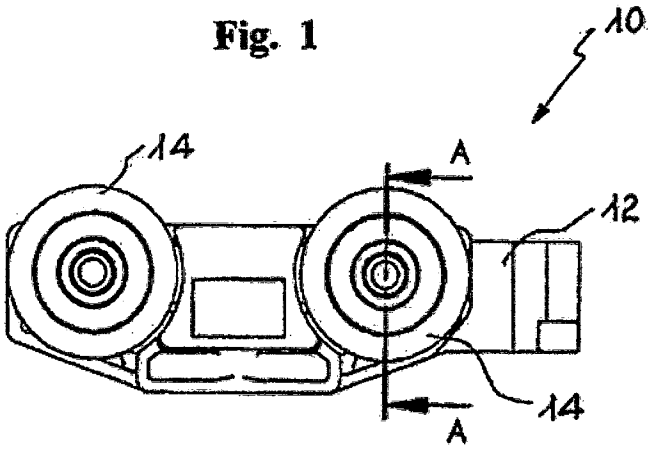

an elastic element (20) placed in a recess (24) made along the opposite sides of the support body (12).

3 Claims, 4 Drawing Sheets

(52) U.S. Cl.
CPC ... *E05Y 2201/688* (2013.01); *E05Y 2600/508* (2013.01); *E05Y 2800/35* (2013.01); *E05Y 2800/676* (2013.01); *E05Y 2900/132* (2013.01)

(56) References Cited

U.S. PATENT DOCUMENTS 3,287,759 A * 11/1966 Foltz ..... E05D 15/063 16/87 R
4,294,455 A * 10/1981 Krueger ..... A63C 17/02 280/11.209
4,457,046 A * 7/1984 Vater ..... E05D 15/063 105/155
5,899,255 A * 5/1999 Petracini ..... A47H 5/06 160/343
8,046,872 B2 * 11/2011 Burgess, III ..... E05D 15/0639 16/97
9,549,643 B2 * 1/2017 Hayes ..... E05D 15/0621
11,002,052 B2 * 5/2021 Terno ..... E05D 15/0626
2010/0101150 A1 * 4/2010 Huang ..... E05D 15/0639 49/409
2019/0242168 A1 * 8/2019 Brun ..... E05D 15/1021

OTHER PUBLICATIONS

Written Opinion of the International Search Authority, dated Jun. 14, 2019 for corresponding PCT patent application No. PCT/EP2019/000101.

* cited by examiner

SECTION A-A

SECTION A-A

CARRIAGE WITH ELASTIC COMPENSATION ELEMENTS FOR MOVING SLIDING DOORS

CROSS REFERENCE TO RELATED APPLICATIONS

This application is a national phase of PCT application No. PCT/EP2019/000101, filed Mar. 29, 2019, which claims priority to IT patent application No. 102018000004273, filed Apr. 6, 2018, all of which are incorporated herein by reference thereto.

DESCRIPTION

The present invention relates to a carriage with elastic compensation elements for moving sliding doors.

More particularly, the present invention relates to a carriage as defined above, especially suitable for moving sliding doors, provided with elastic elements able to compensate for irregularities in the extruded profiles in which the carriage is made to slide, thereby avoiding undesirable noise phenomena that sometimes manifest themselves in a marked manner.

The use of sliding doors is well-known and widespread especially for the purpose of separating two environments without creating encumbrance and detracting from the available space, since they do not protrude angularly during the opening phase but slide parallel to the wall on which the passageway opening is made; in some cases, these doors are of the retractable type, since during the opening phase they are housed in a special seat made in the wall. The movement of said sliding doors is traditionally carried out by means of special carriages, which slide in a guide arranged at the top of the opening and are generally connected to the upper edge of the door. The carriage sliding guide typically consists of an extruded aluminium profile, in which a longitudinally extending seat houses the carriages and delimits their movement on the opposite sides. A first type of carriage currently used in this sector requires that they comprise a rigid structure, in which the pairs of wheels connected to it have a fixed position, always remaining parallel to each other. This known solution manifests a significant drawback, deriving from the fact that the extruded aluminium profiles forming the sliding guides of the carriages may be not perfectly linear or may present deformations along their extension; although slight, these imperfections cause noise, vibrations and squeaking that derive from the movement of the carriages and are particularly unpleasant. Such deformations can occur on the extruded profiles at the time of their installation, for example due to inaccurate fastening or as a function of the non-perpendicular positioning of the relative connection plates.

A second type of sliding door carriage, designed to overcome the drawbacks highlighted above, provides that they are divided into two or more parts; the wheels, in this case, are not rigidly fixed in pairs and can rotate their axis to adapt to the irregularities of the extruded profile. This ensures the constant support of all the wheels on said profile and significantly improves the sliding of the carriages compared to those with fixed wheels. However, this solution also reveals a significant drawback, related to the need to create the structure of the carriage in two parts. In fact, this construction leads to an inevitable weakening of the carriage itself, which can therefore only be used in the presence of doors of limited weight; this weight limit prevents, for example, the use of such carriages in the presence of doors made of glass or crystal, which require a weight capacity of at least 80 kg.

DE 28 19 936 discloses the solution of making a roller for sliding doors, mounted on a support bracket and sliding on a guide; said roller, formed of discs connected to each other on a common axis, is mounted on a support pin inserted in said bracket with the interposition of an elastic layer.

In patent DE 36 02 440, load guided on a carriage is suspended on pins screwed by a bolt; a support pin is arranged with radial clearance in a transverse hole of a suspension plate, which supports the sliding rollers of the carriage, mounted by means of elastic rings.

The purpose of the present invention is to overcome the drawbacks complained of above.

More particularly, the purpose of the present invention is to provide a carriage for sliding doors able to effectively and completely compensate for problems related to possible irregularities existing along the sliding seat of the extruded aluminium profiles, thereby avoiding the resulting noise phenomena and the occurrence of vibrations, squeaking and the like during the movement of the individual carriages.

A further purpose of the invention is to provide a monobloc carriage, therefore particularly robust and able to effectively support even heavyweight doors.

Another no less important purpose of the invention is to provide a carriage for moving sliding doors in which each of the wheels is able to oscillate independently of the others to adapt to possible irregularities of the sliding seat.

A further purpose of the invention is to make available to users a carriage for moving sliding doors suitable to ensure a high level of reliability over time, in addition such as to be easily and economically made.

These and other purposes are achieved by the carriage for moving sliding doors of the present invention according to the main claim.

Figure 2:
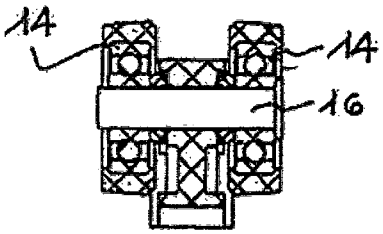
Figure 3:
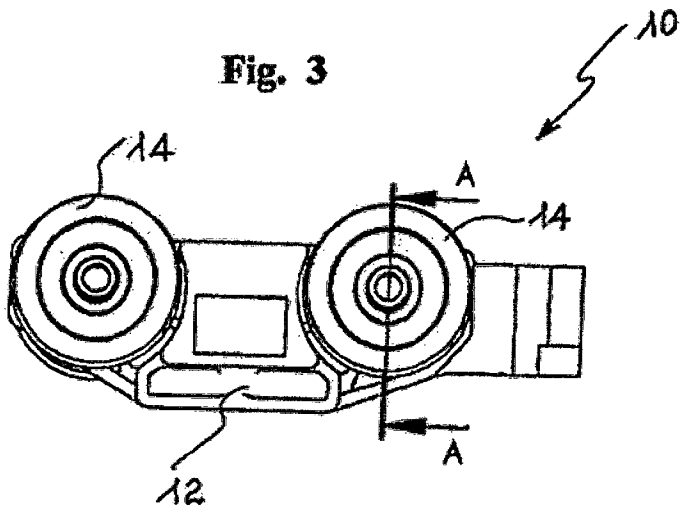
Figure 4:
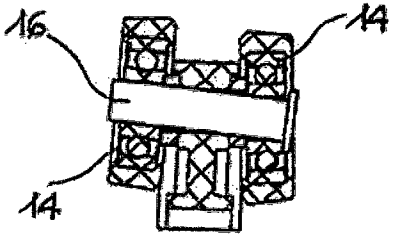
Figure 5:
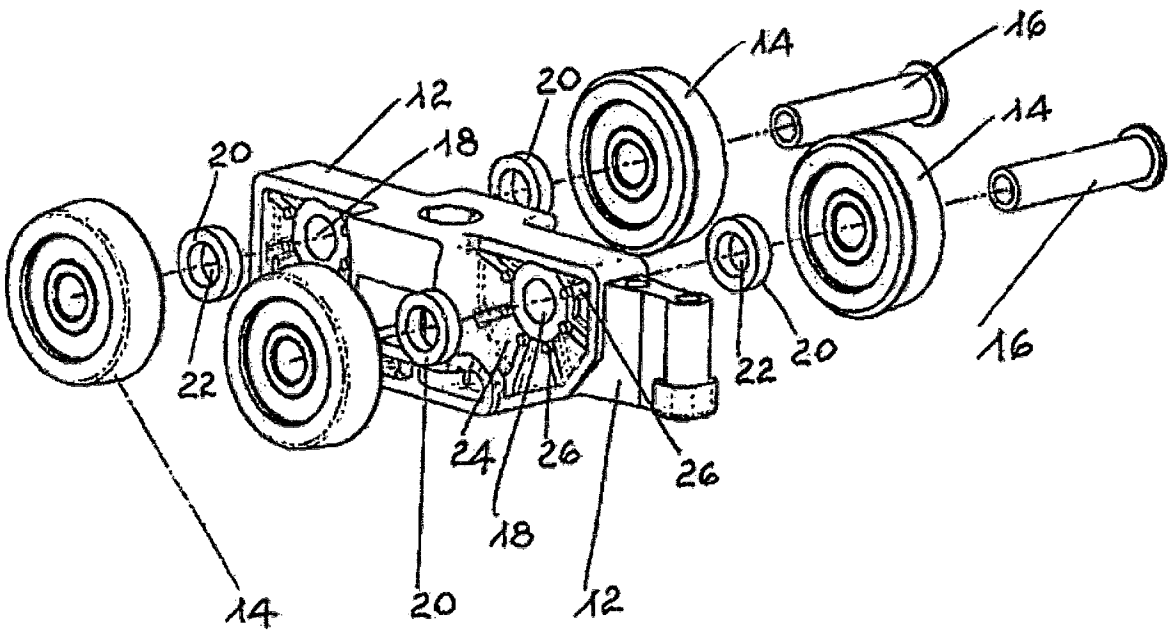
Figure 6:
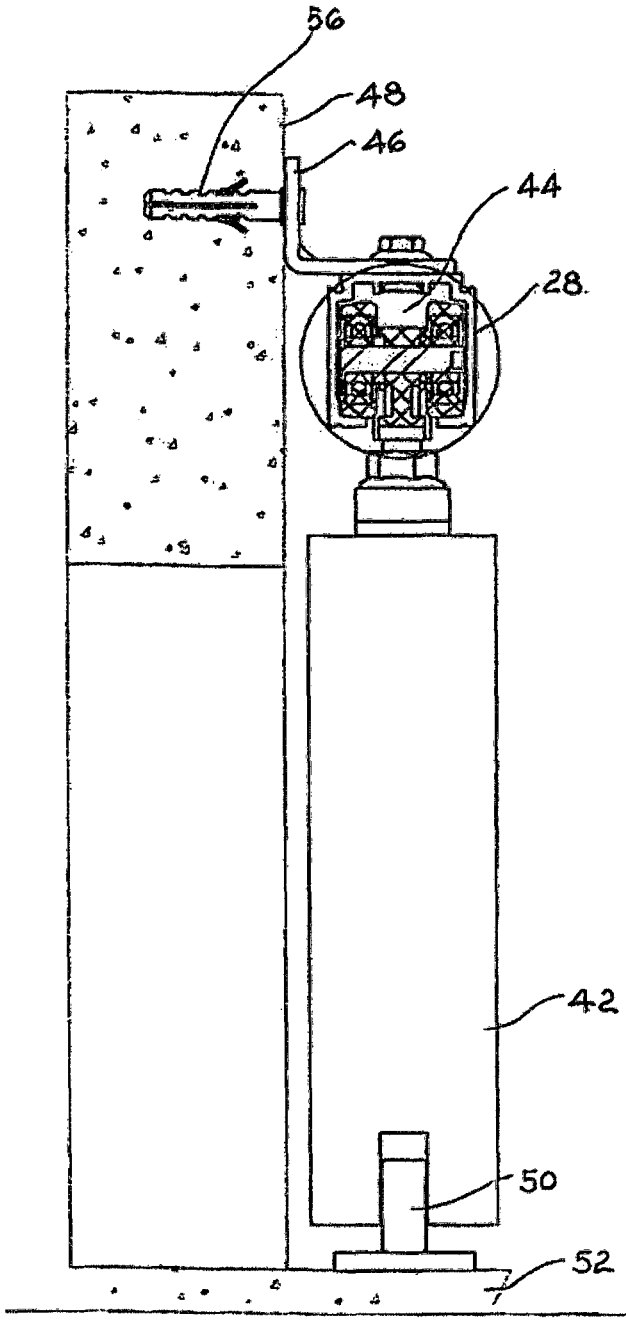
Figure 7:
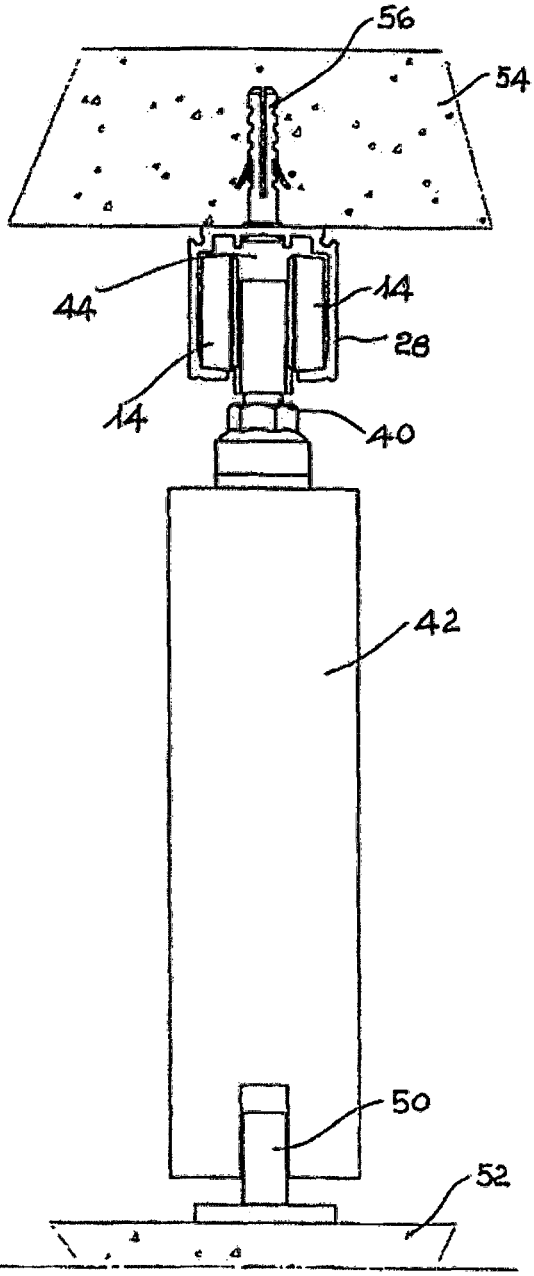
Figure 10:
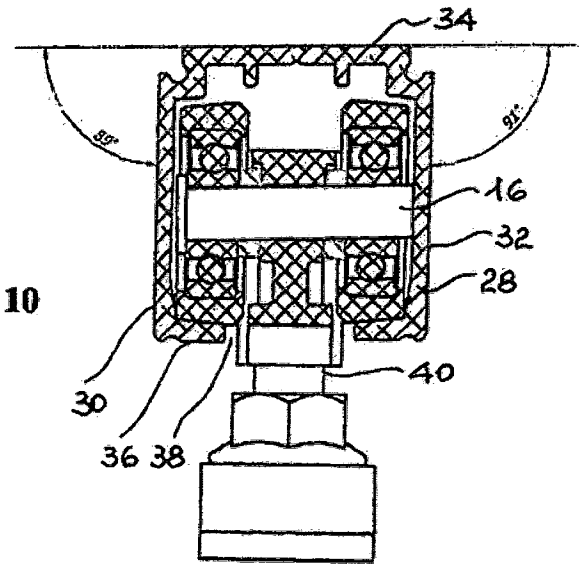

The construction and functional characteristics of the carriage for moving sliding doors of the present invention will be more clearly comprehensible from the detailed description below in which reference is made to the appended drawings which show a preferred and non-limiting embodiment and wherein:

FIG. 1 schematically represents a side view of the carriage of the present invention;

FIG. 2 schematically represents a cross-section along line A-A of FIG. 1 of the same carriage;

FIG. 3 schematically represents a side view of the carriage of the present invention in the misaligned condition of a pair of wheels;

FIG. 4 schematically represents a cross-section along line A-A of FIG. 3 of the same carriage;

FIG. 5 is an exploded schematic view of the carriage of the invention;

FIG. 6 schematically shows in partial cross-section the same carriage, arranged in the extruded profile in which it slides, constrained above to a wall and below to a door;

FIG. 7 schematically shows in partial cross-section the same carriage, arranged in the extruded profile in which it slides, constrained above to the ceiling and below to a door;

FIGS. 8, 9, 10 and 11 exemplify as many possible arrangements of the carriage, in particular of the relative wheels, inside the sliding seat made in said extruded profile and as a function of the possible irregularities existing in said seat.

With initial reference to FIGS. 1 to 5, the carriage for moving sliding doors of the present invention, globally denoted by reference numeral 10 in FIGS. 1 and 3, comprises a support body 12, made of plastic, metal or other suitable material; said body 12, which defines an irregular prismatic shape with a substantially rectangular plan, constitutes the weight-bearing frame of the carriage 10, to which at least two pairs of wheels 14 are connected The two pairs of wheels are suitably spaced apart in the direction of the length of the body 12 and each wheel of each pair is placed on one of the sides of said body. The wheels 14 are typically made of steel bearings, rubberized or with a plastic coating along the rolling surface; as can be seen in particular from FIG. 5, the wheels or bearings 14 are connected to each other in pairs by means of a conventional rivet 16, which engages transversely in the body 12 provided with a corresponding through hole 18.

According to the invention, each of the wheels or bearings 14 is paired to an elastic element 20, arranged between said wheels and the support body 12; the elastic element 20 consists of a washer with a preferably quadrangular or circular cross-section the central hole 22 of which has a diameter equal to or greater than that of a rivet 16 on which it is fitted. Each rivet 16 connects two wheels or bearings 14 to each other, at the same time compressing the elastic elements 20. Advantageously, the elastic elements 20 are arranged in respective recesses 24 of the support body 12, at least in part delimited by a plurality of prominences arranged radially for example in the form of small pegs 26 placed around the holes 18 of said body 12. The elastic elements 20, interposed between the wheels or bearings 14 and the support body 12, are intended to absorb the vibrations that the carriages 10 cause due to deformations or irregularities encountered along the extension of the extruded profile, indicated by reference numeral 28 in FIGS. 6 to 11, in which they are made to slide; the noise is therefore substantially reduced by the presence of the elastic rings 20 combined with the possibility of oscillation of each individual wheel or bearing 14 independently of the others. This last characteristic of the carriages 10 enables the various forms of deformation that are usually found in extruded profiles to be overcome, starting from widenings and narrowings of their outline which can occur during extrusion with respect to the theoretical dimensions; the same being true for the angular deviations of the parallel side surfaces. In the preferred embodiment of the figures, the extruded profile 28 is of the known type generally used for carriages 10 which slide therein and connect to the upper edge of a door; said profile 28 defines a substantially regular quadrangular cross-section, with opposite side walls 30 and 32 parallel and orthogonal to each other with respect to the upper base 34 and the lower base 36. A central slot 38 extending longitudinally is made on the latter which allows a stem 40 to protrude in the direction of the door underneath, indicated by reference numeral 42 in FIGS. 6 and 7, and to connect in a known manner to the upper edge thereof.

FIG. 1 and, above all, FIG. 2 illustrate the situation in which the pairs of wheels or bearings 14 of the carriage 10 are in a condition of precise alignment and are perfectly parallel to each other, meaning that said carriage is sliding along a portion of the extruded profile 28 without any irregularities or deformities; FIGS. 3 and 4, especially the latter, instead illustrate the exemplary situation in which one of the wheels of a pair of wheels or bearings 14 of the carriage 10 is in the off axis position and is raised angularly with respect to the other, meaning that said carriage is sliding on a portion of the extruded profile 28 that has an irregularity along the base on which said wheel rests. Since the wheels or bearings 14 are independent of each other, this irregularity is compensated automatically thanks to the presence of the elastic element 20, which is compressed and allows the carriage to adapt to the irregularity.

Figure 8:
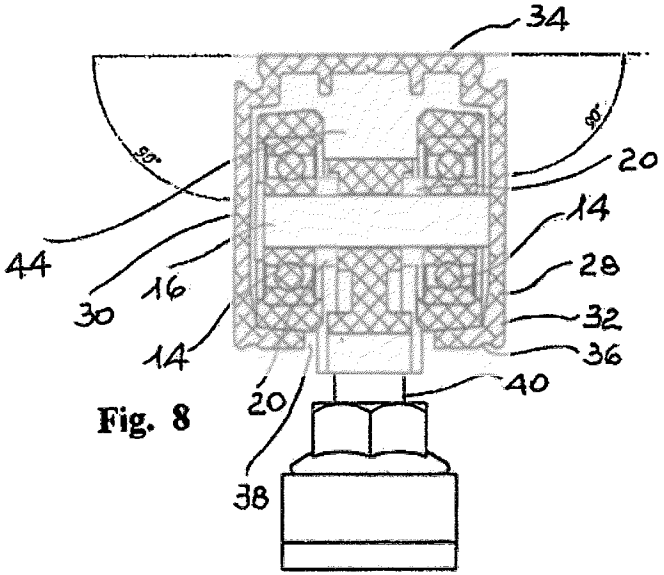

FIGS. 8 to 11 schematically represent as many possible conditions in which the carriage 10 may find itself inside the extruded profile 28; the irregularities of the latter are generally minor, but still sufficient to create noise. FIG. 8 assumes the condition of normality and perfect alignment of the carriage 10 in the sliding seat, indicated by reference numeral 44, existing inside the extruded profile 28; the opposite side walls 30 and 32 of the profile 28 are in fact precisely oriented at 90° with respect to the upper base 34 and this situation indicates the absence of irregularities or deformities of the profile itself.

Figure 9:
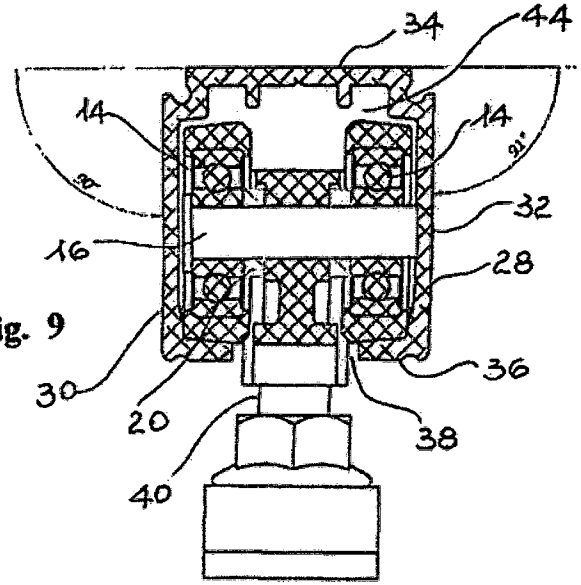

FIG. 9 assumes a condition of irregularity in the extension of the profile 28, which highlights on one side an angle of 90° between the side wall 30 and the upper base 34, but on the opposite side defines instead an angle of 91° between the side wall 32 and the upper base 34; the values indicated are by way of example but are used to emphasize that even a minimum dimensional anomaly can be critical for the correct sliding of the carriage 10 and that with the use of the elastic elements 20 these anomalies are compensated.

FIG. 9 illustrates a further possible condition, in which both the side walls 30 and 32 of the profile 28 are not perfectly orthogonal with respect to the upper base 34; on one side 89° and on the opposite side 91°, which configures an irregularity of greater importance with respect to the previous hypothesis; however, given the provision of arranging the elastic elements 20 between each wheel or bearing 14 and the support body 12, given in addition that said wheels are independent of each other, it is easy to compensate in this case also to ensure the correct sliding of the carriage 10 without appreciable noise in the seat 44.

Figure 11:
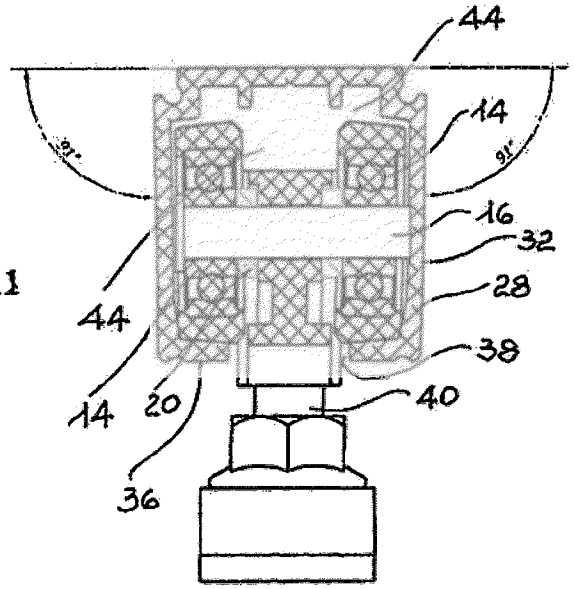

A further example of possible forming defects of the extruded profile 28, which can in any case be compensated with the use of the elastic elements 20 according to the invention, is illustrated in FIG. 11, in which both the side walls 30 and 32 of said profile are closed in equal measure at 91° instead of 90° with respect to the upper base 34.

For completeness, FIGS. 6 and 7 propose two possible alternative solutions for fastening the door 42 in connection with the use of the carriage 10 according to the invention. In detail, FIG. 6 illustrates the fastening to the wall, by means of a conventional bracket 46 and one or more expansion plugs 56, of the extruded profile 28 in which said carriage 10 slides; the door 42, in this case, remains cantilevered with respect to the wall 48, while at the base it slides on a skid 50 or the like fixed to the floor 52, according to a known solution. In FIG. 6, the extruded profile 28 in which the carriage 10 slides is instead fixed to the ceiling 54 by means of conventional expansion plugs 56.

As may be seen from the above, the advantages which the invention achieves are evident.

In the carriage 10 for moving sliding doors 42 of the present invention, the positioning of an elastic element 20 between each wheel of the pairs of wheels or bearings 14 and the support body 10 allows effective compensation of the forming irregularities of the extruded profile 28 in the seat 44 of which said carriage slides, avoiding annoying phenomena of accentuated noise; this compensation is achieved in part thanks to the fact that said wheels are independent of each other and can oscillate individually as needed according to the varying of the aforementioned irregularities of said extruded profile 28.

Despite the invention having been described above with particular reference to one of its embodiments, given solely by way of a non-limiting example, numerous modifications and variants will appear evident to a person skilled in the art in the light of the above description. The present invention therefore sets out to embrace all the modifications and variants which fall within the sphere and scope of the following claims.

The invention claimed is:

1. A carriage for moving a sliding door along an extruded profile fixed to a wall or a ceiling, said carriage comprising:

a support body for supporting the sliding door on a sliding seat of the extruded profile, said support body having opposing sides provided with respective recesses and through openings or holes for the passage of rivets;

elastic elements respectively placed in the recesses;

pegs arranged radially about the through openings or holes and delimiting at least a portion of said elastic elements; and one or more pairs of wheels connected to the support body with rivets, said wheels respectively engaged against the elastic elements for resilient angular and vertical movement of the wheels independent of each other in response to irregularities or deformities of the extruded profile encountered by the carriage during movement of the carriage along the sliding seat of the extruded profile.

2. The carriage according to claim 1, characterized in that the elastic element consists of a square or circular section washer the central hole of which has a diameter equal to or greater than that of the rivet on which it is fitted.

3. The carriage according to claim 1, characterized in that said support body of the pairs of wheels defines an irregular prismatic shape with a substantially rectangular plan, said wheels being made of steel bearings, rubberized or with a plastic coating along the rolling surface.

* * * * *